United States Patent [19]

Tai

[11] Patent Number: 4,713,193

[45] Date of Patent: Dec. 15, 1987

[54] STABLE, FREE-FLOWING PARTICULATE ADJUNCTS FOR USE IN DETERGENT COMPOSITIONS

[75] Inventor: Ho Tan Tai, Lille, France

[73] Assignee: Lever Brothers Company, New York, N.Y.

[21] Appl. No.: 884,664

[22] Filed: Jul. 15, 1986

Related U.S. Application Data

[63] Continuation of Ser. No. 669,152, Nov. 7, 1984, abandoned.

[30] Foreign Application Priority Data

Nov. 9, 1983 [GB] United Kingdom ..... 8329880

[51] Int. Cl.[4] ..... C11D 3/12; C11D 3/37; C11D 11/02; C11D 17/06

[52] U.S. Cl. ..... 252/91; 252/8.8; 252/89.1; 252/174; 252/174.11; 252/174.12; 252/174.13; 252/174.15; 252/174.21; 252/174.25; 252/179; 502/407

[58] Field of Search ..... 252/140, 174.14, 89.1, 252/174.25, 179, 174, 91, 174.13, 174.15, 174.12, 174.21, 8.8; 502/407

[56] References Cited

U.S. PATENT DOCUMENTS

| | | | |
|---|---|---|---|
| 3,769,222 | 10/1973 | Yurko et al. | 252/174.25 |
| 4,136,051 | 1/1979 | Saran | 252/91 |
| 4,184,975 | 1/1980 | Krings et al. | 252/140 |
| 4,190,551 | 2/1980 | Murata et al. | 252/99 |
| 4,264,464 | 4/1981 | Gangwisch et al. | 252/91 |
| 4,288,342 | 9/1981 | Wagner | 252/140 |
| 4,304,675 | 12/1981 | Corey | 252/8.6 |
| 4,311,607 | 1/1982 | Kaeser | 252/140 |
| 4,347,152 | 8/1982 | Wixon | 252/174 |
| 4,368,134 | 1/1983 | Kaeser | 252/140 |
| 4,397,777 | 8/1983 | Yurko | 252/536 |
| 4,399,048 | 8/1983 | Gangwisch et al. | 252/91 |
| 4,406,808 | 9/1983 | Gangwisch | 252/91 |
| 4,414,130 | 11/1983 | Cheng | 252/140 |

FOREIGN PATENT DOCUMENTS

| | | | |
|---|---|---|---|
| 490542 | 1/1976 | Australia . | |
| 1134800 | 11/1982 | Canada | 252/179 |
| 32767A1 | 3/1983 | Fed. Rep. of Germany . | |
| 44297A1 | 5/1983 | Fed. Rep. of Germany . | |
| 53-141308 | 12/1976 | Japan . | |
| 57-192500 | 11/1982 | Japan . | |
| 58-67795 | 4/1983 | Japan . | |
| 1437076 | 5/1976 | United Kingdom . | |

*Primary Examiner*—Dennis L. Albrecht
*Attorney, Agent, or Firm*—Milton L. Honig; James J. Farrell

[57] ABSTRACT

A stable, free-flowing particulate adjunct suitable for use in particulate detergent compositions consists essentially of a liquid, viscous liquid, oily or waxy adjunct absorbed into a granular zeolite material of a particle size distribution of between 50 to 500 μm and having a bulk density of about 450 to 600 g/l. Suitable adjuncts are nonionic surfactants, silicones, waxes and hydrocarbons, fabric softening compounds and perfumes.

Use of said particulate free-flowing adjuncts in particulate detergent compositions is also disclosed.

5 Claims, No Drawings

STABLE, FREE-FLOWING PARTICULATE ADJUNCTS FOR USE IN DETERGENT COMPOSITIONS

This is a continuation, application of Ser. No. 669,152, filed Nov. 7, 1984, now abandoned.

This invention relates to stable, free-flowing particulate adjuncts and their use in detergent compositions.

Many adjuncts which provide special properties to detergent compositions are liquid, viscous liquid, oily or waxy materials under normal temperature conditions. As such can be named, for example, nonionic surfactants; silicones, waxes and hydrocarbons; fabric softening compounds such as the fatty primary, secondary or tertiary amines and cationic quaternary ammonium compounds; liquid enzyme slurries and perfumes.

It is often difficult to incorporate such adjuncts satisfactorily into a particulate detergent composition. Such adjuncts, when incorporated, normally tend to give processing problems, tend to result in sticky powders with a tendency to caking during storage, and are liable to decompose or bleed from the powder.

For many years nonionic surfactants which are waxy or viscous liquids at room temperature have been used in small amounts in so-called mixed active detergent formulations, primarily to reduce the amount of foam generated during the washing cycle. Recently, nonionic surfactants have been used in increasing amounts to provide for an improved fatty soil removal and an increase in the bulk density of the powder. It is however known that if a substantial amount of nonionic surfactant, e.g. above 5% by weight, is incorporated into the detergent slurry before spray-drying, a significant air-pollution problem, known as "blue smoke", is encountered.

Silicone oils usable as foam depressant, when incorporated into the detergent slurry before spray-drying tend to decompose; the same happens to fatty amines, e.g. long-chain tertiary amines as adjuncts for fabric softening-in-the-wash, enzymes and perfumes.

In the manufacture of particulate detergent compositions comprising such adjuncts, these adjuncts are therefore preferably not incorporated in the detergent slurry before spray-drying, but are added to the spray-dried detergent base powder by spraying them in liquid or liquefied form by melting or in solvent-dissolution directly onto the spray-dried detergent base granules. A disadvantage of this method is that it cannot be used to incorporate adequate quantities of the adjunct, especially nonionic surfactants and fatty amines, as required for the desired effect, without getting into problems with respect to free-flowingness, stickiness, caking and bleeding of the particulate detergent compositions.

Another disadvantage is that it does not provide adequate protection against decomposition or interaction of certain adjuncts.

Another known method is spraying the adjunct in liquid or liquefied form by melting or in solvent-dissolution onto a carrier material, which is then mixed with the detergent base formulation. For this purpose various carrier materials have been proposed in the art, but the type of carrier material proposed is normally dependent upon the type of liquid adjunct to be carried. Many of these carrier materials are unsuitable or have limited absorption capacity for certain liquid adjuncts. Specific carrier materials for nonionic surfactants are for example described in U.S. Pat. No. 3,769,222, including microsized silicon dioxide, sodium perborate monohydrate and clays, such as bentonite and zeolite.

It has now been found that a granular type of zeolite material having particle size distribution of between 50 and 500 μm and a bulk density of about 450–600 g/l can be used as an excellent general purpose carrier material for almost any liquid, waxy or oily adjunct to form a stable, free-flowing particulate adjunct which can be suitably mixed with any particulate detergent composition without caking and stability problems.

The term "Zeolite" used herein refers to a crystalline aluminosilicate material having the general formula:

$$(Cat_{2/n}O)_x.Al_2O_3.(SiO_2)_y.z\ H_2O,$$

wherein Cat. is a cation having valency n that is exchangeable with Calcium (e.g. $Na^+$ or $K^+$); x is a number from 0.7–1.5; y is a number from 1.3–4; and z is such that the bound water content is from 10% to 28% by weight.

A preferred Zeolite for use in preparing the granular carrier material is the commercially available product known as Zeolite A, which is typically:

$$Na_2O.\ Al_2O_3.\ 2\ SiO_2 \sim 4.5\ H_2O$$

and which can also be described by the unit cell content:

$$Na_{12}[(AlO_2)_{12}.(SiO_2)_{12}].27\ H_2O.$$

The granular carrier material of the invention, which can be obtained by preparing an aqueous slurry of Zeolite and a filler which is then subjected to a spray-drying process, generally comprises from about 65 to 85% by weight of Zeolite and from 15 to 35% by weight of filler and water. It has a high absorption capacity, much higher than any finely divided zeolite type normally used as partial or complete substitute of phosphates in detergent compositions, such that it can readily absorb up to about 100% of its weight of almost any type of liquid, waxy or oily adjuncts, such as nonionic surfactants, silicones, waxes and hydrocarbons, long-chain fatty amines, to a sufficient extent, without the risk of the liquid adjunct bleeding.

Examples of fillers which can be used with zeolite to form the granular zeolite material are sodium sulphate, sodium nitrilotriacetate and sodium silicates.

The granular zeolite material preferably used in the present invention will comprise from 65 to 85% by weight of Zeolite A, from 5 to 15% by weight of sodium sulphate and from 10 to 20% by weight of water. Preferably the granular zeolite material will have an average particle size of about 150–200 μm.

The particles containing such liquid adjunct remain rigid and free-flowing, feel dry and yet show good disintegration properties on contact with water, liberating both the liquid adjunct and the zeolite serving as a builder.

The invention therefore provides a stable, free-flowing particulate adjunct suitable for use in particulate detergent compositions, consisting essentially of a liquid, viscous liquid, oily or waxy adjunct absorbed in a granular zeolite material of a particle size distribution of between 50 and 500 μm and having a bulk density of about 450–600 g/l.

The invention also provides a particulate detergent composition containing a liquid, viscous liquid, oily or waxy adjunct which provides special properties to the composition, characterized in that the adjunct is incorporated as a stable, free-flowing particulate material by absorption into a granular zeolite material of a particle size distribution of between 50 and 500 μm and having a bulk density of about 450–600 g/l.

Although the invention will have general applicability to transform liquid adjuncts into particulate material, it is particularly suitable for obtaining free-flowing particulate nonionic adjuncts, fabric softening adjuncts and foam-controlling adjuncts.

By using the invention it is also possible to prepare high bulk density high nonionic detergent compositions, wherein all the nonionic surfactants do not form part of the detergent slurry composition before spray-drying. The invention has an additional advantage in that, in view of the zeolite applied, less phosphate builder can be used and so limitations that have been placed gradually on the use of polyphosphate builder salts, such as sodium triphosphate, due to alleged detrimental ecological effects thereof, can be effected.

EXAMPLES 1–7

The following free-flowing particulate adjuncts were prepared by spraying the liquid or liquefied adjuncts on to granular zeolite material (Zeolite HAB A40 compound* ex Degussa) in a pan-granulator:

(1)

65% Zeolite HAB A40 compound
31% primary fatty amine (Noram® SH ex CECA)
3.5% Synperonic® A7 nonionic surfactant ex ICI
0.5% fine silica.

(2)

70% Zeolite HAB A40 compound
30% Alcalase® enzyme slurry (1850 GU/mg)

(3)

b 70% Zeolite HAB A40 compound
25% Alcalgase® enzyme slurry
5% glycerol/borax/sulphite mixture (4)

80% Zeolite HAB A40 compound
20% silicone oil DB 100 ex Dow Corning (5)

65% Zeolite HAB A40 compound
28% liquid enzyme slurry
1.25% sodium pentaborate
5.75% water.

(6)

65% Zeolite HAB A40 compound
35% Synperonic® A7 nonionic surfactant (7)

65% Zeolite HAB A40 compound
35% perfume oil

* Zeolite HAB A40 compound is a spray-dried granular Zeolite material composed of 77% Zeolite A, 8% $Na_2SO_4$ and 15% $H_2O$, having an average particle size of 165 μm and a bulk density of about 530 g/l.

Synperonic is a registered trade-mark. Synperonic A7 is a fatty alcohol condensed with an average of 7 ethylene oxide groups.

Alcalase is a registered trade-mark. It is a proteolytic enzyme supplied by the NOVO Industries, Copenhagen, Denmark.

For comparison, granules were prepared by spraying molten Synperonic® A7 ($C_{13}$–$C_{15}$ alcohol-7 ethylene oxide) nonionic on to molecular sieve Zeolite A (3–4 μm) The granules obtained therefrom and containing only 25% of nonionic were rather sticky and tended to agglomerate. It was only after weathering by blowing with dry air that a very fine particulate material was obtained. In contrast with the particulate material of Example (6) of the invention containing 35% of the same nonionic compound which is free-flowing, feels hard and non-fatty, the material in which finely divided Zeolite A is used as carrier is fragile and feels soft and fatty.

EXAMPLE 8

A high bulk density nonionic-based heavy duty detergent formulation was prepared by dry-mixing the following components:

| | | | % by weight |
|---|---|---|---|
| Sodium triphosphate LV ex Rhone Poulenc | | | 37.00 |
| Sodium metasilicate ex Rhone Poulenc | | | 4.00 |
| EDTA (ethylene diamine tetraacetate) | | | 0.20 |
| Optical brightener | | | 0.25 |
| TAED/STP** granules | | | 4.00 |
| Enzyme granules (1100 Glycine units) | | | 0.95 |
| Antifoam granules | | | 1.20 |
| SCMC | | | 0.50 |
| Zeolite HAB A40 compound | 65% | particles | 36.10 |
| Synperonic A7 nonionic | 35% | | |
| Sodium perborate monohydrate | 72% | particles | 15.30 |
| Synperonic® A7 nonionic | 28% | | |
| Rest perfume, stabiliser, water | | | up to 100%. |

The bulk density of this powder was 0.9.
The powder remained stable and free-flowing with no sign of nonionic bleeding on the pack during storage.
**TAED = Tetraacetyl ethylene diamine
STP = Sodium tripolyphosphate

EXAMPLE 9

Adjunct granules were prepared by spraying molten primary fatty amine onto Zeolite HAB A40 compound to obtain a free-flowing granulated softening adjunct material containing 70% HAB A40 compound +30% primary fatty amine.

These granules were incorporated in a conventional particulate detergent composition in an amount of about 10% by weight. The composition remained stable and free-flowing during storage and gave satisfatory cleaning and softening to fabrics washed therewith.

I claim:

1. Stable, free-flowing, particulate adjunct suitable for use in particulate detergent compositions consisting essentially of a spray-dried zeolite granular material having absorbed therein a liquid, viscous liquid, oily or waxy adjunct in an amount of from at least about 54% up to 100% of its weight, said granular zeolite material consisting essentially of 65 to 85% by weight of zeolite and 15 to 35% by weight of sodium sulphate and water, and having a particle size distribution of between 50 and 500 microns, and a bulk density of from 450 to 600 g/l.

2. Stable, free-flowing, particulate adjunct according to claim 1, wherein said granular zeolite material comprises from 65–85% by weight of Zeolite A, from 5 to 15% by weight of sodium sulphate and from 10 to 20% by weight of water.

3. Stable, free-flowing, particulate adjunct according to claim 1, wherein said granular zeolite material has an average particle size of about 50–200 μm.

4. Stable, free-flowing, particulate adjunct according to claim 1, wherein said adjunct is selected from the group of nonionic surfactant, silicones, waxes and hydrocarbons, fabric softening compounds, enzymes and perfumes.

5. Stable, free-flowing, particulate adjunct suitable for use in particulate detergent compositions consisting essentially of a spray-dried zeolite granular material having absorbed therein a liquid silicone oil in an amount of from 25% up to 100% of its weight, said granular zeolite material consisting essentially of 65 to 85% by weight of zeolite and 15 to 35% by weight of sodium sulphate and water, and having a particle size distribution of between 50 and 500 microns, and a bulk density of from 450 to 600 g/l.

* * * * *